US010697193B2

(12) United States Patent
Tafuro et al.

(10) Patent No.: US 10,697,193 B2
(45) Date of Patent: Jun. 30, 2020

(54) PORTABLE MULTI-FUNCTIONAL SYSTEM AND REALIZATION METHOD THEREOF

(71) Applicant: R.I. S.P.A. MODULAR BUILDING SYSTEM, Trepuzzi (IT)

(72) Inventors: Salvatore Tafuro, Trepuzzi (IT); Cosimo Tafuro, Lecce (IT)

(73) Assignee: R.I. S.P.A. MODULAR BUILDING SYSTEM, Trepuzzi (LE) (IT)

( * ) Notice: Subject to any disclaimer, the term of this patent is extended or adjusted under 35 U.S.C. 154(b) by 0 days.

(21) Appl. No.: 16/466,836

(22) PCT Filed: Sep. 18, 2017

(86) PCT No.: PCT/IB2017/001248
§ 371 (c)(1),
(2) Date: Jun. 5, 2019

(87) PCT Pub. No.: WO2018/109542
PCT Pub. Date: Jun. 21, 2018

(65) Prior Publication Data

US 2019/0345730 A1 Nov. 14, 2019

(30) Foreign Application Priority Data

Dec. 16, 2016 (IT) ..... 102016127442

(51) Int. Cl.
*E04H 12/18* (2006.01)
*E04B 1/343* (2006.01)
(Continued)

(52) U.S. Cl.
CPC ..... *E04H 12/182* (2013.01); *E04B 1/34305* (2013.01); *E04B 1/34336* (2013.01);
(Continued)

(58) Field of Classification Search
CPC . E04H 12/182; E04H 12/187; E04B 1/34305; E04B 1/34336; E04B 1/34357; E04B 2001/34394; E06B 3/486
See application file for complete search history.

(56) References Cited

U.S. PATENT DOCUMENTS 1,426,276 A * 8/1922 Christie ..... E04H 12/182 52/28
2,576,389 A * 11/1951 Craighead ..... E04H 12/182 52/121

(Continued)

FOREIGN PATENT DOCUMENTS

GB 2520675 A 6/2015
WO 2015052642 A1 4/2015

OTHER PUBLICATIONS

International Search Report and Written Opinion for Corresponding International Application No. PCT/IB2017/001248 (11 Pages) (dated Jan. 3, 2018).

*Primary Examiner* — Brian D Mattei
(74) *Attorney, Agent, or Firm* — Lucas & Mercanti, LLP

(57) ABSTRACT

A portable multi-functional system having a multi-functional apparatus customizable by way of devices arranged to respectively perform different functions, and a container arranged to be transported by way of ground, naval or air transportation and having predetermined external dimensions is provided. The multi-functional apparatus is secured to the container, and is arranged to take at least two types of layout: a first layout or transport layout wherein the multi-functional apparatus is inside the predetermined external dimensions and a second layout or lifting up layout wherein the multi-functional apparatus projects from the predetermined external dimensions of the container so as to realize a tower. The invention also relates to a method for realizing the multi-functional system.

9 Claims, 7 Drawing Sheets

(51) Int. Cl.
*E06B 3/48* (2006.01)
*E04H 1/12* (2006.01)

(52) U.S. Cl.
CPC ..... *E04H 12/187* (2013.01); *E06B 3/486* (2013.01); *E04H 2001/1283* (2013.01)

(56) References Cited

U.S. PATENT DOCUMENTS 3,000,473 A * 9/1961 Reynolds ..... B66F 11/04 52/121
3,439,467 A * 4/1969 Partlow ..... F21V 21/22 52/632
5,102,179 A * 4/1992 Royer ..... A01M 31/025 182/141
5,280,985 A * 1/1994 Morris ..... B60P 1/02 296/26.15
5,862,827 A * 1/1999 Howze ..... A01M 31/025 135/140
6,460,653 B1 * 10/2002 Hardy ..... A01M 31/02 182/63.1
7,188,635 B2 * 3/2007 Johnson ..... A01M 31/02 135/87
9,016,001 B2 * 4/2015 Heger ..... E04B 1/34357 52/79.5
9,248,775 B2 * 2/2016 McGowen ..... B60P 3/24
9,630,666 B1 * 4/2017 Keene ..... B62D 63/061
9,920,512 B1 * 3/2018 Eisold ..... E04B 1/343
2003/0000769 A1 * 1/2003 Pyle ..... E06C 1/39 182/63.1
2004/0216395 A1 * 11/2004 Wentworth, Jr. ... E04B 1/34305 52/79.5
2005/0194807 A1 * 9/2005 Gonzalez ..... A01M 31/025 296/26.05
2005/0284035 A1 * 12/2005 DeOvando ..... E04B 1/3431 52/79.1
2006/0162999 A1 * 7/2006 Atkins ..... A01M 31/02 182/63.1
2007/0045046 A1 * 3/2007 Hayes ..... A01M 31/02 182/63.1
2007/0074933 A1 * 4/2007 Kerns ..... A01M 31/025 182/127
2008/0307717 A1 * 12/2008 Heppner ..... A01M 31/025 52/64
2010/0074723 A1 * 3/2010 Lancon ..... B65D 21/086 414/800
2011/0120026 A1 * 5/2011 Hache ..... B60P 3/14 52/79.5
2012/0006369 A1 * 1/2012 Cantin ..... E04B 1/34305 135/96
2014/0259971 A1 * 9/2014 Bikker ..... A47K 4/00 52/34
2015/0028025 A1 * 1/2015 Mullaney ..... E04H 1/12 220/1.5
2015/0211225 A1 * 7/2015 Vazquez ..... E04H 1/12 52/40
2015/0300321 A1 10/2015 Haar
2016/0138290 A1 * 5/2016 Dautaj ..... E04H 3/02 52/67
2017/0356204 A1 * 12/2017 Lyons, Jr. ..... E04H 1/1205
2019/0085575 A1 * 3/2019 Opoku ..... E04H 1/1205

* cited by examiner

PORTABLE MULTI-FUNCTIONAL SYSTEM AND REALIZATION METHOD THEREOF

CROSS-REFERENCE TO RELATED APPLICATIONS

This application is a 371 of PCT/IB2017/001248, filed Sep. 18, 2017, which claims the benefit of Italian Patent Application No. 102016000127442, filed Dec. 16, 2016.

TECHNICAL FIELD

The present invention relates, in general, to a system comprising multi-functional and transportability features.

In particular the present invention relates to a transportable system suitable for use in multiple working conditions for multiple uses.

More in particular the present invention relates to a configurable transportable system capable of performing a plurality of functions.

BACKGROUND ART

Multi-functional systems are known arranged to be configured from time to time as a function of specific and/or urgent needs in certain operating zones.

For example, configurable systems are known to be used as radio-links for emergencies such as earthquakes or saturation of telephone lines.

Configurable systems are also known to be used as video surveillance or air traffic control stations, for example in emergency situations and/or critical failures in fixed installations.

Applicant, in general, has noted that known multi-functional systems are difficult to be transported and located in intended operating zones, so that times to set running such systems are particularly costly and difficult.

In specific technical fields, systems are known arranged to perform specific functions.

For instance, patent application US2005/194807_A1 discloses a trailer with wheels capable of being towed by a vehicle. The trailer comprises a cabin that can be telescopically raised for observing, filming and photographing animals.

Patent application US2007/074933_A1 discloses a further trailer with wheels capable of being towed by a vehicle. The trailer comprises a base and a platform that can be lifted telescopically as to the base for loading objects or vehicles of different sizes inside the compartment made by the base and the platform.

Patent application US2015/0300321_A1 discloses a container comprising a generator set. The container comprises a base that can be configured in transport mode and in operating mode. In transport mode the container base is held horizontally while in operating mode the base is rotated 90° so that one of the sides stays on the ground and allows the use of the generator set comprised in the container.

Patent application GB_2520675_A discloses a mobile system for treating or purifying water having features similar to those of patent application US2015/0300321_A1.

Such a known system comprises a base and a tower-shaped water treatment structure configured so that the structure can be erected to a vertical position from a horizontal position for allowing water treatment.

Patent application WO2015/052642_A1 discloses a surveillance system which includes a tower and a cabin, located at the base of the system.

The tower, in use, is supported by a telescopic vertical rod that is at least partially contained inside the cabin whose base supports the telescopic rod.

Applicant has noted that even in these specific examples, transport and installation of the trailers disclosed in the first two documents, in some cases, require special towing means and kits. Moreover the trailers require to be easily adaptable to be transported in particularly difficult operating zones.

Applicant has also noted that in other cases known systems have extremely specialized structures and configurations and therefore are difficult to be adapted, as a function of needs, to highly different configurations and functions.

In general, Applicant has noted that the known art does not seem able to effectively solve the problem of making available multi-functional systems or even specific systems quickly and effectively, such as in emergency situations or in particularly difficult operating zones, when shape and size of such systems require configurations of a certain complexity.

DISCLOSURE OF THE INVENTION

Object of the present invention is thus to solve the above outlined problems of the known prior art.

Such an object is achieved by way of a portable multi-functional system as claimed.

The present invention also relates to a method for realizing a portable multi-functional system.

Claims are an integral part of the teaching of the present invention.

The following summary of the invention is provided in order to provide a basic understanding of some aspects and features of the invention. This summary is not an extensive overview of the invention, and as such it is not intended to particularly identify key or critical elements of the invention, or to delineate the scope of the invention. Its sole purpose is to present some concepts of the invention in a simplified form as a prelude to the more detailed description that is presented below.

According to a feature of a preferred embodiment, the system comprises a container adapted to be transported by way of ground, naval or air transportation, and a multi-functional apparatus fastened to the container and configured to project, in use, from the container, and realize a tower.

According to a further feature of the present invention, the container of the system comprises external dimensions in accordance with ISO 10, 20 or 40 feet (305, 610, 1220 cm) containers.

According to another feature of the present invention, the multi-functional apparatus comprises at the top of the tower a cabin configured for use by a limited number of people.

BRIEF DESCRIPTION OF DRAWINGS

These and further features and advantages of the present invention will appear more clearly from the following detailed description of preferred embodiments, provided by way of non-limiting examples with reference to the attached drawings, in which components designated by same or similar reference numerals indicate components having same or similar functionality and construction and wherein.

BEST MODES FOR CARRYING OUT THE INVENTION

Figure 1:
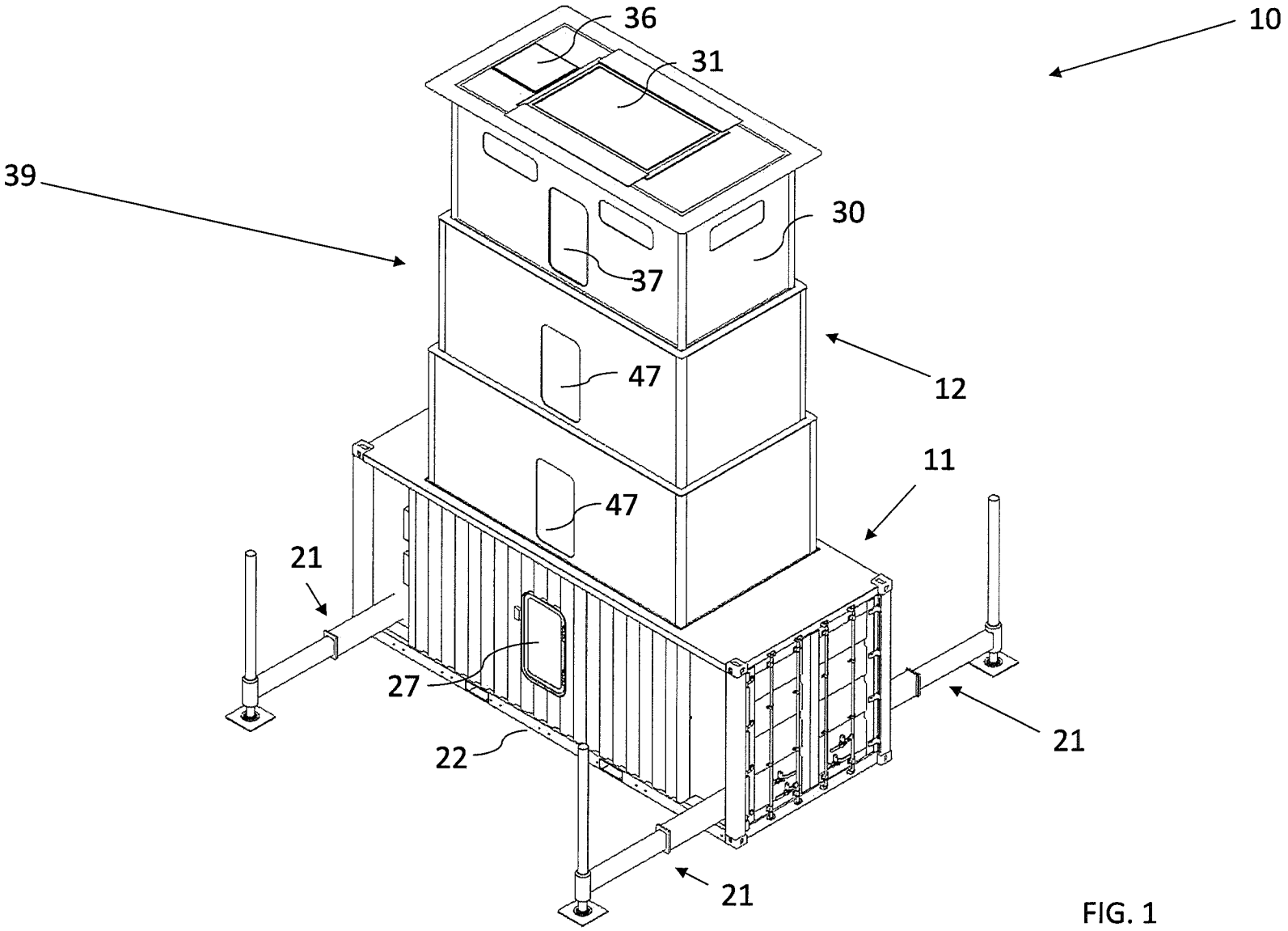
FIG. 1 shows a first example of use of a multi-functional system according to a preferred embodiment.
Figure 2A:
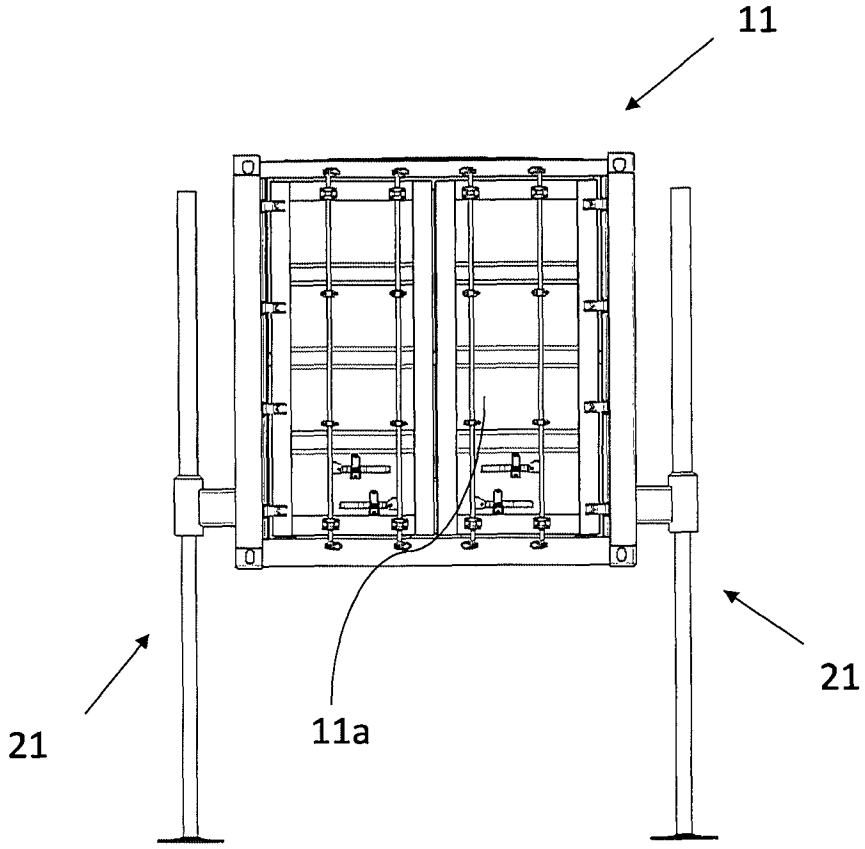
FIGS. 2*a* and 2*b* show examples for arranging the multi-functional system to be loaded on or unloaded from transport means.
Figure 2B:
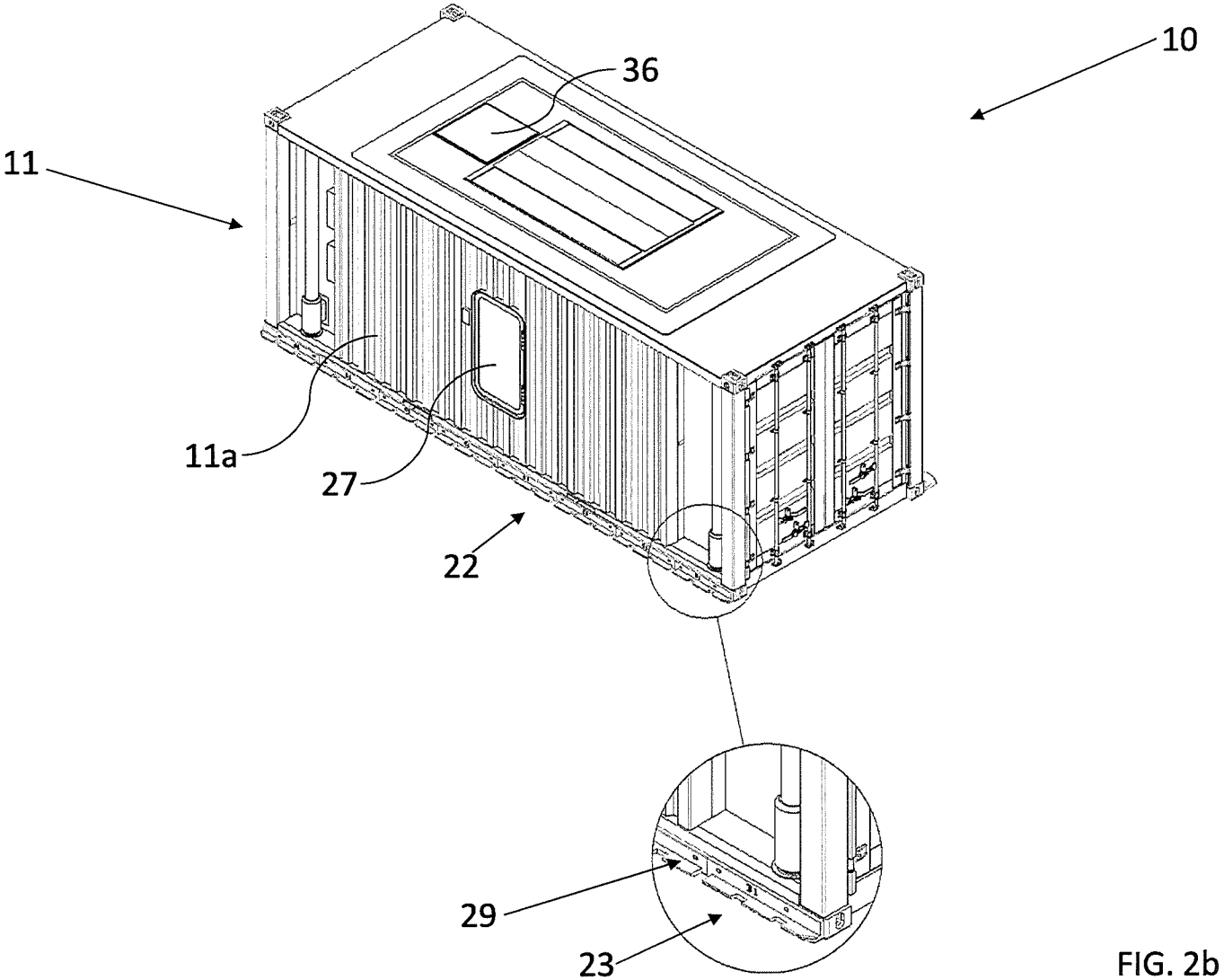
Figure 3A:
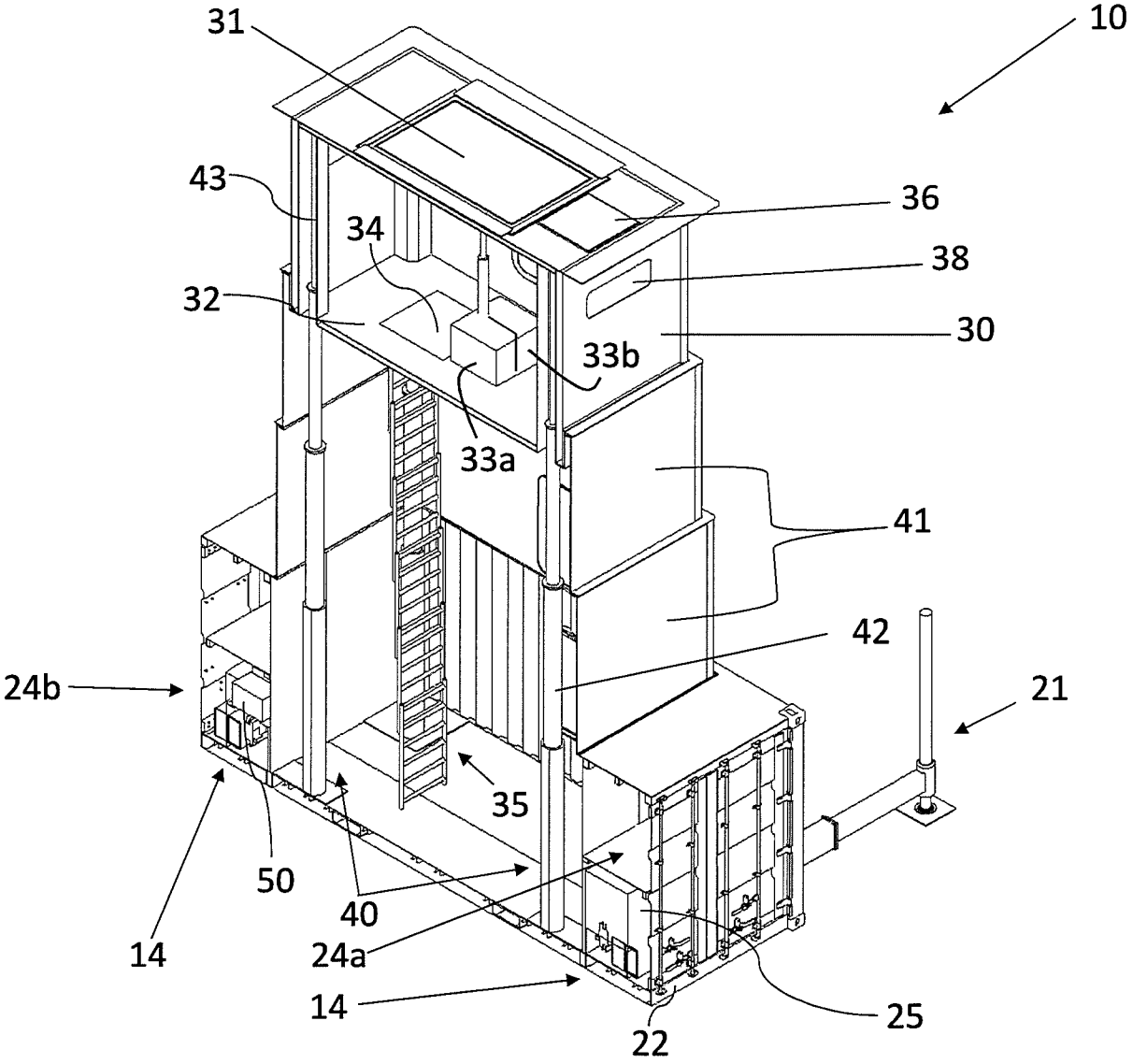
FIGS. 3*a* and 3*b* show a section plane of the multi-functional system shown in FIG. 1.

With reference to FIG. 1, a multi-functional system 10 according to the preferred embodiment comprises a shelter or basic container 11 of predetermined dimensions, a multi-functional apparatus 12, preferably comprising a multi-functional cabin (cabin) 30, and power supply and control devices 14 (FIG. 1, FIG. 3*a*) configured to power and handle, preferably autonomously, both the shelter 11 and the multi-functional apparatus 12.

The multi-functional apparatus 12 is preferably comprised into the predetermined dimensions of the shelter 11, and is configured to lift the cabin 30 in vertical direction as to the shelter 11 so as to preferably realize a variable height tower 39 comprising on top, for example, a cabin 30.

It should be noted that, according to the present description, terms like horizontal, vertical, upper, lower are used in accordance with the conventionally contemplated common use.

It should also be noted that in the present description the term shelter or container is meant an equipment designed to be transported and comprised of a predetermined set of external dimensions.

The shelter 11 is preferably an ISO (International Organization for Standardization) type shelter, which comprises pre-determined dimensions 11*a* (FIG. 1, FIG. 2*a*, FIG. 2*b*, FIG. 3*a*), such as a width "W" of 8 feet (244 cm), a height "H" of 8 feet and 6 inches (259 cm) and a length "L" of 10, 20, or 40 feet (299, 606 or 1210 cm) and is configured to be transported, for example, as a common container or shelter of known type.

In case the shelter is a ISO standard type shelter, preferably this can be stacked both above and under other ISO type containers allowing storage thereof on shelter lines or columns and optimization of space, volume, and weight management.

According to other embodiments the shelter 11 is a shelter comprising a body of predetermined dimensions arranged, for instance, to be easily transportable according to predefined constructive specifications.

According to the preferred embodiment, the container 11 preferably comprises four arms 21 and a support base 22 comprising four vertexes. Preferably, the four arms are embedded in the body in special compartments located at the four vertexes of the container 11.

Preferably, the four arms 21 are extractable, extensible and/or hinged, in a known way, at the vertexes of the container 11 and configured to allow releasing of the multi-functional system 10 from transport means, i.e. facilitate that the multi-functional systems 10 be loaded on and unloaded from the transport means.

Even more preferably, arms 21 are also configured to be laterally extended with respect to the shelter and act as static or self-levelling stabilizers to increase the base of the multi-functional system 10 and ensure its levelling even in operating zones comprising level differences.

In particular, arms 21 are controlled by a hydraulic control unit 50, comprised in the power supply and control devices 14, preferably configured to automatically control levelling of the multi-functional system 10.

Even more preferably, the hydraulic control unit 50 is configured to automatically restore a proper levelling and installation (self-levelling) of the system 10.

Preferably, the shelter 11, at opposite ends of the length "L" of the support base 22, respectively, comprises technical compartments 24*a*, 24*b* configured to accommodate the power supply and control devices 14 and/or spare parts provided to make the multi-functional system 10 functionally self-sufficient under any use conditions.

In particular, the shelter 11 preferably comprises power supply and control devices 14 such as, for example, one or more electric generators, one or more air conditioners, etc., configured to autonomously and independently perform, in use, several operations.

The power supply and control devices 14, in accordance with a possible different embodiment, can be assisted or replaced by photovoltaic panels, awnings or cloths or equivalent means positioned outside the tower and designed to provide power to the electrical devices of the system, such as to security and control devices.

According to a possible different embodiment, it is provided that the shelter 11 comprises in a lower outer structure 23 removable devices 29 named "Longerons", of known type, configured to allow loading the container inside a hold of aircrafts, such as, for example, the aircraft holds of the Lockheed Model C 130 J, without the aid of any special support. According to this embodiment, it is provided that the "Longerons", when not in use, may be stored inside the container 11.

Preferably, the container 11 also comprises a door, such as an outer door 27 positioned on the outer surface of the container, for example next a cabin face 30, when the multi-functional apparatus 12 is completely contained within the container 11. Such a configuration of the container 11 allows to make the cabin 30 easily accessible, controllable and usable for various functions in order to arrange, before use, the multi-functional system 10 to the functions that can be provided for.

The multi-functional apparatus 12 comprised in the multi-functional system 10, according to the preferred embodiment, comprises the multi-functional cabin (cabin) 30, that can be used, for example, by a limited number of persons or operators, a plurality of telescopic intermediate elements (telescopic elements) 41 and lifting devices 40 connected to the cabin and configured to lift the cabin 30 together with the telescopic elements 41 at certain variable heights depending on use needs.

According to the preferred embodiment, each telescopic element 41 comprises a door 47 positioned in correspondence of the door 27 provided on the outer surface of the shelter 11; each telescopic element 41 is configured to cover the entire outer surface of the tower 39, when in use.

According to the preferred embodiment, the cabin 30 of the multi-functional apparatus 12 comprises a trampling floor 32 and, on a top wall, a platform 31; the cabin is preferably configured as an operating room suitable for accommodating at least one operator.

The cabin 30 preferably comprises one or more of the following devices, depending on the type of function provided for the multi-functional system 10:

- a door 37 positioned in correspondence of doors 47 in the telescopic elements 41 and of the door 27 comprised in the outer surface of the shelter 11, and arranged to be used, for example, under storage or transport conditions;

equipages, technological devices or consoles provided, in general, for the full functionality of the system 10; such equipages, devices or consoles also comprise, for example, devices 33*a* configured to perform surveillance or video surveillance operations, or control and command consoles 33*b* configured to control and command devices provided, for example, for air or telephone control and installed on the platform 31 of the cabin 30. In the case of devices provided on the platform, it is preferably provided that the platform may be raised autonomously by means of the devices 33*a* present in the cabin 30. According to other embodiments, platform 31 may be remotely raised by means of suitable receiving/transmission apparatuses or may also be of fixed type;

autonomous air-conditioning, if the cabin requires the presence of one or more persons;

a first scuttle 34 provided on the trampling floor 32 associated, for example, to a ladder 35, for example an internal retractable ladder, and arranged for granting access from inside the cabin 30.

a second scuttle 36, for example, provided as access to the platform 31 or as emergency exit, and associated, preferably, to a safety ladder placed inside the cabin 30;

one or more windows 38 allowing to one or more persons in the cabin to observe and/or monitor the outside area of the cabin 30.

Figure 3B:
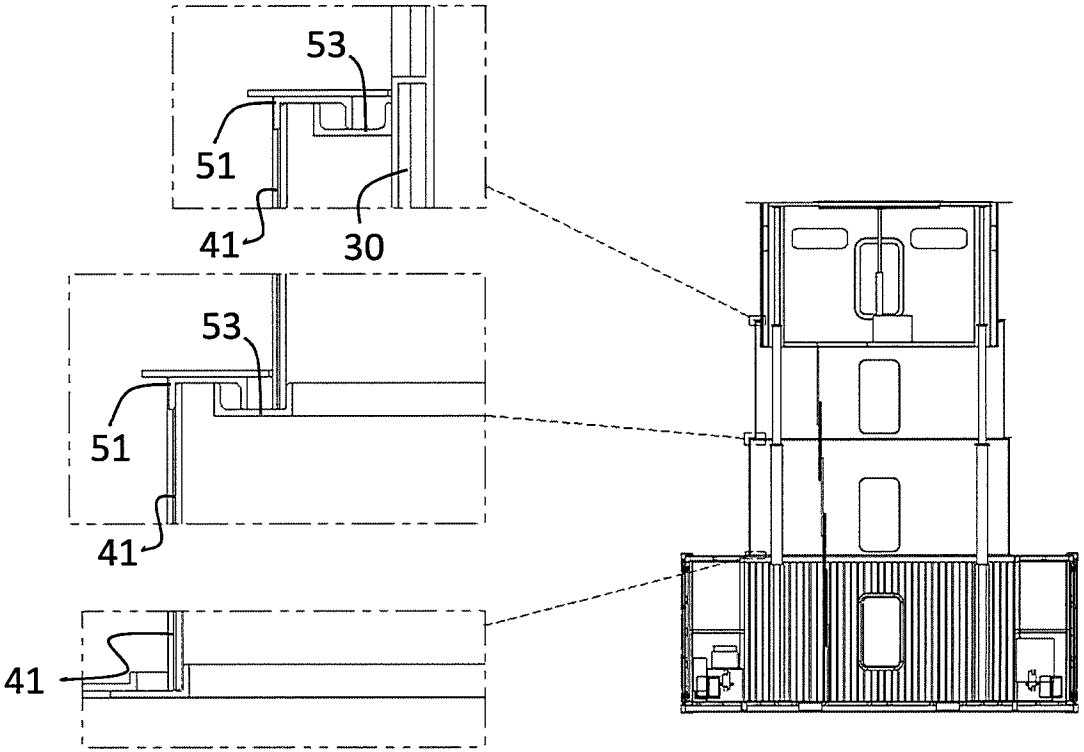

According to the preferred embodiment, the lifting devices comprised in the multi-functional apparatus 12 are configured to lift the cabin 30 to various heights, for example, three to four times the height "H" of the shelter 11, in case of a 20 feet shelter, or five to six times the height "H" of the shelter 11, in case of a 40 feet shelter, under the control of technological installations, accessories, equipages 25 provided in the technical compartments 24*a*, 24*b*, and comprise in the preferred embodiment:

the retractable ladder 35, for instance an internal ladder that lengthens or shortens according to the movement of the cabin 30. For example, the retractable ladder 35, preferably, comprises a plurality of elements sliding one over the other, is fastened as upper position to the trampling floor 32 of the cabin 30 and as lower position to the base 22 of the shelter 11. The extension of the ladder corresponds, in use, to the position in height of the cabin 30;

intermediate telescopic elements 41, for example of neutral type, configured to be dragged in height by the cabin 30; in particular, according to the preferred embodiment, the transmission of the telescopic movement by the cabin 30 to the various telescopic elements 41 is effected, for example, by a coupling made between lower frames 53 (FIG. 3*a*, FIG. 3*b*), with a shape of male type, and upper frames 51, with a shape of female type. More particularly, a first telescopic element 41 is coupled to a limit stop of the lifting of the cabin 30, thanks to the coupling between the lower frame 53, with a shape of male type fixed to the cabin 30, and the upper frame 51, with a shape of female type fixed to the telescopic element 41, so as to provide the vertical lifting movement. Similarly, the same type of coupling acts as a puller of each upper telescopic element 41 with respect to a respective lower telescopic element 41. Such a coupling is arranged to overcome the gravity force and to act as a puller by way of each upper telescopic element 41 with respect to a respective lower telescopic element 41. Such coupling is configured to overcome the force of gravity and allows, from time to time, when the vertical drag is upward, lifting of telescopic elements and cabin, and the construction of tower 39; unlike in case of cabin downward, the gravity force is such to ensure the downward movement of the telescopic elements 41. In all cases the coupling between the frames 51, 53 is of a sealed type in order to guarantee protection against atmospheric agents. Of course, according to other embodiments, the coupling between the cabin and the telescopic elements can be accomplished in other ways without thereby departing from the scope herein exemplified;

guides 42 and hydraulic pistons 43 for vertically lifting the cabin 30 to different heights as a function of the multi-purpose requirements provided.

According to further embodiments, the lifting devices 40 comprised in the multi-functional device 12 are configured to lift the cabin 30 to heights even higher than that above disclosed as a function of the size and weight of the cabin and of the shelter without departing from the scope of the invention as disclosed and claimed.

According to still other embodiments, lifting devices 40 may include components of a type other than those disclosed without thereby departing from the scope of the invention as disclosed and claimed.

According to the exemplified disclosed embodiment, the power supply and control devices 14 are comprised in the technical compartments 24*a*, 24*b*.

Preferably, the multi-functional system 10 is configured so as to receive electrical power either through an external electrical network connection or through power supply and control devices 14 housed inside the technical compartments 24*a*, 24*b*.

According to possible variants, the power supply and control devices 14 can be connected to electrical circuits of transport vehicles arranged to transport the system 10.

According to other variants, it is provided that power supply and control devices 14 are powered by renewable energy sources.

In general, it is provided that power supply and control devices 14 comprise, for example, one or more of the following components:

General electric board, of known type;

Power generator with tank;

Lighting and emergency system;

Fire alarm;

Video intercom system from door 27 to cabin 30;

Air conditioner and/or air control system;

Lightning conductor;

Earthing system;

Exterior search headlamps with high lighting capacity, with swing or fixed systems and switching on and off possibility, even remotely;

Electrical systems for cabin lifting devices 30.

Electrical systems for driving the arms 21 for self-releasing and/or for stabilizing the system 10.

In general, according to various embodiments, the technical compartments 24*a*, 24*b* are configured so as to comprise devices such to make the multi-functional system 10 fully autonomous depending on the type of function the system is intended to be dedicated to.

The operation of the multi-functional system as disclosed above is the following.

Under storage or transport conditions, system 10 is configured to comprise external dimensions, preferably corresponding to those of a shelter of 10, 20 or 40 feet according to ISO standards.

Therefore, in such conditions, the system 10 may preferably be transported as a common container by way of ground, naval or air transportation.

Preferably, the system 10 may, according to needs, be organized, prior to transportation, for various uses requiring the presence of a tower to be located in a certain operating zone.

For example, system organization may provide that in the technical compartments 24*a* and 24*b* and/or in the cabin are comprised under transport conditions but ready for immediate operational use:

Radio or radar devices;

Air control devices;

Meteorological monitoring devices;

Surveillance or video surveillance devices;

or other devices that anyway require to be installed at a height higher, preferably much higher, than that of a container so that they can be considered devices installed on a tower.

System organization may for example provide that accessories are stored in the technical compartments 24*a*, 24*b*, as possible support to the devices positioned in the cabin as well as that parts and/or tools and/or utensils of various type and kind are stored in the technical compartments, depending on possible maintenance or repair requirements of the cabin devices.

Once the system is ready, this is transported, thanks to the container dimensions, by way of transport means in the operating zone with no special equipment and positioned and, possibly, levelled thanks to the arms 21.

After positioning, the cabin 30 and the intermediate telescopic elements 41 are raised by way of the guides 42 and the hydraulic pistons 43.

Lifting carries the cabin 30, preferably at the maximum height, for example 3-4 times or 5-6 times the height of the basic container, depending on the type of container, but can also carry the cabin to all intermediate heights since the guides and the hydraulic pistons 43 are configured to lift the cabin 30 in a progressive manner.

Preferably, in the positioning and levelling phases and in the lifting phase, activation of buzzers is envisaged for audio signalling either entry into operation of horizontal or stabilizing arms 21 or vertical movement of the telescopic elements 41.

According to other embodiments, preferably, at the lifting and/or ending of the lifting phase, it is provided the activation of external light bodies, such as intermittent lamps, for visually signalling entry into operation of the telescopic elements 41.

The intermediate telescopic elements 41 are fully or partially lifted in direct relation to the lifting of the cabin 30 and the internal retractable ladder 35 is configured so as to extend or shorten following the movement of the cabin 30 due to the fact that the telescopic intermediate elements 41 do not have floors or ceilings and are pulled by the cabin 30.

Under use conditions, access to the cabin 30 is always granted within the system by way of the first scuttle 34 located on the cabin trampling floor 32; the floor 32 acts as a support base of the intermediate telescopic elements 41, arranged to ensure a vertical progressive extension.

Under use conditions, the second scuttle 36, that is located on the top wall of the cabin 30 and associated to a safety ladder located on the platform 31, allows access to platform 31 and possibly ensures, in the event of an emergency, a possible escape route from the cabin 30.

In summary, based on the above disclosure, it can be stated that the multi-functional system can take one or more of the following setups or operating configurations:

1°) TRANSPORT LAYOUT:

completely lowered and compacted to the size of a shelter, preferably of a ISO 10, 20 or 40 feet shelter.

2°) LOADING/UNLOADING LAYOUT:

hydraulic loading/unloading arms activated and arranged to loading/unloading operations, preferably in a complete energy autonomy.

3°) LEVELLING AND STABILIZATION LAYOUT:

arms 21 arranged to operate as a static bracing, allowing the support system base to be increased so as to provide that the system 10 withstand static and dynamic stresses during use as a tower.

4°) ELEVATION LAYOUT

Comprising, for instance:

4a°) MINIMUM ELEVATION LAYOUT:

the cabin 30 set in motion by the lifting devices 40 reaches a first level minimum height.

4b°) INTERMEDIATE ELEVATION LAYOUT:

the cabin 30 set in motion by the lifting devices 40 reaches intermediate heights.

4c°) MAXIMUM ELEVATION LAYOUT:

the cabin 30 set in motion by the lifting devices 40 reaches the maximum height and vertical dimension as a function of constructive characteristics and of the shelter dimensions 11.

Advantageously, the system 10 according to the description and/or to the disclosed possible variants has the following advantages over the prior art:

It can travel by land—by sea—by air;

It can be transported and used in operating zones in a very short time by internally comprising surveillance or video-surveillance devices 33*a* and/or control and command consoles 33*b* provided for the full functionality of the cabin and/or of the system 10;

It can be allocated on unplanned and remote locations, devoid, for example, of sources of energy;

It can be used as a mobile tower and can be used at various heights depending on the type of application and on the type of functions expected, and possibly it is also remotely controlled;

The hydraulic arms located at the vertexes allow, even autonomously powered, the system to self-unloading/self-loading, and preferably to self-levelling still on rugged grounds.

It can be compacted in a shelter or air portable container.

It can be easily moved from the bottom through pockets for forks and from above by means of cables, hinges or chains that are arranged to engage corner blocks, preferably provided for the handling and stacking shelters of known type.

Inside the system, it is possible to accommodate a usable and equipped cabin, suitable to be habitable; the cabin can be raised to three or more levels by way of lifting devices 40, preferably comprising guides 42 and hydraulic pistons 43, so that the system can perform the various functions to which it is provided for.

Also in transport and storage conditions, the cabin 30 is accessible, inspectable, and usable for the functions it is provided for by accessing through the outer door 27 provided on the perimeter of the container 11, through the doors 47 on the telescopic intermediate elements 41 and through the door 37 provided on the cabin 30.

Access to the cabin is granted under all use conditions by way of the ladder 35 and the first scuttle 34 accessible from inside.

The provided safety means ensures the evacuation of possible operators (in the various operating modes) through the second scuttle 36 associated to the safety ladder.

Advantageously, according to the preferred embodiment, the system does not need additional external devices for transportation and operation since, preferably, the power supply and control devices 14 are comprised within the system, for example in the technical compartments 24*a*, 24*b* inside the container 11, properly organized and dimensioned to a plurality of purposes.

Indeed, the system internally comprises, preferably, all the components useful to its operation and to the execution of different work configurations.

Advantageously, the system, thanks to the disclosed modular structure, is easily transportable and equally easily convertible. As verified by the Applicant the system is convertible in a tower adaptable to different working conditions in a very short time, for instance in 30 minutes.

Advantageously, the system 10 can be used in all areas where the presence of a tower easily transportable and adaptable to different working conditions is required, for example in areas where height and portability are a key operation requirement.

Advantageously, the telescopic elements, when extracted from the container, are arranged to protect the system from atmospheric agents.

Figure 4:
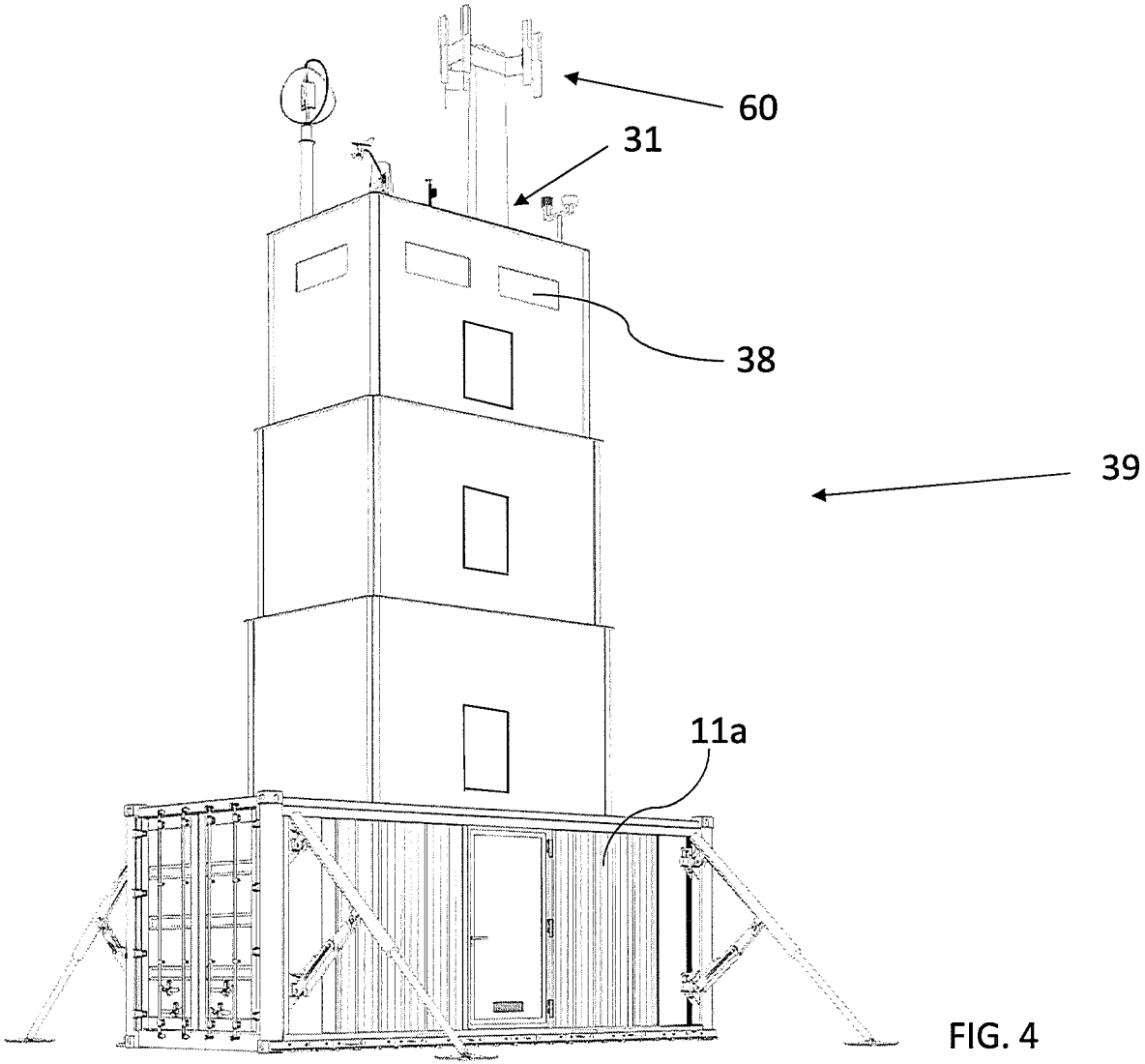
FIG. 4 shows a second example of use of a multi-functional system according to a second preferred embodiment.

Some examples are reported herein below intended to be not exhaustive but only exemplificative of different uses of the disclosed system:

Telecommunications, for instance as a decentralized radio station and/or radio link, by way of radio antennas 60 (FIG. 4) positioned, for example, on the platform 31; in this use field, but also in others, the system 10 can be used for data collection and manipulation, and/or for interaction and re-elaboration of data exchanged between one or more systems located each from the other in different areas, possibly for the management of surrounding operating zones.

Meteorology, as a relocated monitoring station and/or survey station.

Video surveillance and/or border control, as a control station even in areas of difficult access due to natural or remote environments.

Figure 5:
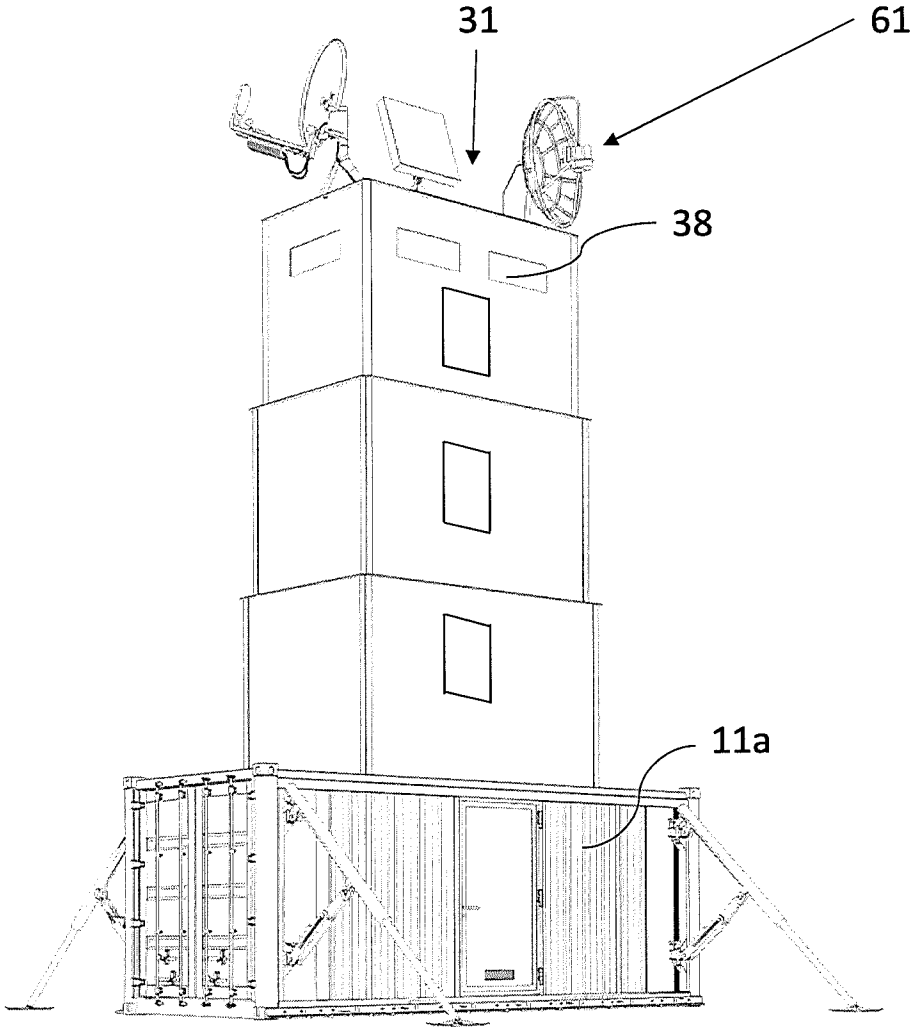
FIG. 5 shows a third example of use of a multi-functional system according to a third preferred embodiment.

Aeronautic applications, as a control tower and/or radar antenna comprising radar antennas 61 (FIG. 5) positioned, for example, on the platform 31.

Naval applications as a lighthouse and/or observation tower.

Entertainment and/or interaction and/or messaging by way of audio and video devices arranged for people positioned outside the system.

Of course, obvious changes and/or variations to the above disclosure are possible, as regards dimensions, shapes, materials, components and connections, as well as details of of the described construction and operation method without departing from the scope of the invention as defined by the claims that follow.

The invention claimed is:

1. A portable multi-functional system comprising:

a multi-functional customizable apparatus, a container comprising predetermined external dimensions and arranged to be transported by way of ground, naval or air transportation, said multi-functional apparatus being secured to said container, and arranged to take at least two types of layout:

a first layout or transport layout wherein the multi-functional apparatus is comprised inside said predetermined external dimensions of said container;

a second layout or lifting up layout wherein the multi-functional apparatus projects from said predetermined external dimensions of said container so as to realize a tower, wherein said multi-functional apparatus comprises:

a cabin;

a plurality of telescopic elements among said cabin and said container;

lifting devices connected to the cabin and arranged to lift the cabin, together with the telescopic elements, with respect to said container so as to shape said tower with the cabin on top, the lifting devices comprised inside the cabin, said cabin comprising, on an upper wall, when in said second layout, a platform comprising one or more device types external to the upper wall of the cabin.

2. The multi-functional system according to claim 1, wherein said predetermined external dimensions of said container comprise dimensions selected from the group consisting of:

10 feet or 299 cm ISO dimensions;

20 feet or 606 cm ISO dimensions; and 40 feet or 1210 cm ISO dimensions.

3. The multi-functional system according to claim 2, wherein said cabin comprises one or more windows.

4. The multi-functional system according to claim 2, wherein said container comprises located at four vertexes of said container, and contained inside the predetermined external dimensions extractable and extensible or hinged arms arranged for unloading from transport vehicles and/or for stabilizing the multi-functional system.

5. The multi-functional system according to claim 1, wherein said cabin comprises one or more windows.

6. The multi-functional system according to claim 5, wherein said container comprises located at four vertexes of said container, and contained inside the predetermined external dimensions extractable and extensible or hinged arms arranged for unloading from transport vehicles and/or for stabilizing the multi-functional system.

7. The multi-functional system according to claim 1, wherein said container comprises located at four vertexes of said container, and contained inside the predetermined external dimensions extractable and extensible or hinged arms arranged for unloading from transport vehicles and/or for stabilizing the multi-functional system.

8. A method for realizing a portable multi-functional system, comprising the steps of:

providing a multi-functional customizable apparatus, providing a container arranged to be transported by way of ground, naval or air transportation, and comprising predetermined external dimensions, securing said multi-functional apparatus to said container so as to be comprised inside said predetermined external dimensions of said container;

projecting, in use, the multi-functional apparatus out of said predetermined external dimensions so as to realize a tower, wherein said step of providing the multi-functional customizable apparatus comprises the steps of:

providing, in use, a cabin comprising on an upper wall a platform comprising one or more device types external to the upper wall of the cabin, and a scuttle arranged to grant access to the platform of the cabin;

providing a plurality of telescopic components among said cabin and said container;

providing lifting devices connected to the cabin, and inside the cabin;

lifting up the cabin together with the telescopic components.

9. A portable multi-functional system comprising:

a multi-functional customizable apparatus, a container comprising predetermined external dimensions and arranged to be transported by way of ground, naval or air transportation, said multi-functional apparatus being secured to said container, and arranged to take at least two types of layout:

a first layout or transport layout wherein the multi-functional apparatus is comprised inside said predetermined external dimensions of said container;

a second layout or lifting up layout wherein the multi-functional apparatus projects from said predetermined external dimensions of said container so as to realize a tower, wherein said multi-functional apparatus comprises:

a cabin;

a plurality of telescopic elements among said cabin and said container;

lifting devices connected to the cabin and arranged to lift the cabin, together with the telescopic elements, with respect to said container so as to shape said tower with the cabin on top, said cabin comprises, on an upper wall, when in said second layout, a platform comprising one or more device types external to the upper wall of the cabin;

said cabin comprising a scuttle arranged to grant access to the upper wall of the cabin, when in said second layout;

wherein said platform is arranged to be raised by way of cabin devices comprised inside the cabin.

* * * * *